US010807101B2

(12) United States Patent
Pallin et al.

(10) Patent No.: US 10,807,101 B2
(45) Date of Patent: Oct. 20, 2020

(54) DEVICE FOR CAPTURING AND REMOVING MAGNETIC MATERIAL IN A FLOW OF MATERIAL

(71) Applicant: JAGTECH AS, Heimdal (NO)

(72) Inventors: Jan Egil Pallin, Heimdal (NO); Geir Olav Aanesbug, Meldal (NO)

(73) Assignee: JAGTECH AS, Heimdal (NO)

( * ) Notice: Subject to any disclaimer, the term of this patent is extended or adjusted under 35 U.S.C. 154(b) by 151 days.

(21) Appl. No.: 15/563,069

(22) PCT Filed: Mar. 30, 2016

(86) PCT No.: PCT/NO2016/050057
§ 371 (c)(1),
(2) Date: Sep. 29, 2017

(87) PCT Pub. No.: WO2016/159779
PCT Pub. Date: Oct. 6, 2016

(65) Prior Publication Data

US 2018/0078947 A1 Mar. 22, 2018

(30) Foreign Application Priority Data

Mar. 30, 2015 (NO) ..... 20150389
Oct. 19, 2015 (NO) ..... 20151424

(51) Int. Cl.
*B03C 1/28* (2006.01)
*B03C 1/033* (2006.01)

(52) U.S. Cl.
CPC ..... *B03C 1/284* (2013.01); *B03C 1/0332* (2013.01); *B03C 1/0335* (2013.01); *B03C 1/286* (2013.01);
(Continued)

(58) Field of Classification Search
CPC ..... B03C 1/284; B03C 1/0332; B03C 1/0335; B03C 1/286; B03C 2201/28;
(Continued)

(56) References Cited

U.S. PATENT DOCUMENTS 4,457,838 A * 7/1984 Carr ..... B03C 1/284 209/223.2
4,946,589 A * 8/1990 Hayes ..... B01D 35/06 209/223.1
(Continued)

FOREIGN PATENT DOCUMENTS

DE 3218791 A1 3/1983
WO 9714502 A1 4/1997
(Continued)

OTHER PUBLICATIONS

International Search Report and Written Opinion dated Aug. 9, 2016 (PCT/NO2016/050057).

*Primary Examiner* — Claire A Norris
*Assistant Examiner* — Ekandra S. Miller-Cruz
(74) *Attorney, Agent, or Firm* — Alix, Yale & Ristas, LLP

(57) ABSTRACT

Device for capturing and removing magnetic material from a flow of material, wherein the device includes magnet assemblies including magnet rods for capturing magnetic material in a flow of material passing the magnet assemblies and where the magnet assemblies are removably arranged to a frame assembly of the device, wherein each magnet assembly includes a set of at least two magnet rods.

18 Claims, 10 Drawing Sheets

(52) U.S. Cl.
CPC ..... *B03C 2201/18* (2013.01); *B03C 2201/28* (2013.01)

(58) Field of Classification Search
CPC ..... B03C 2201/18; B03C 1/00; B03C 1/032; B03C 1/034; B03C 1/08; B03C 1/14; B03C 1/22; B03C 2201/22; B03C 1/02; B03C 1/031; B01D 21/00; B01D 21/0009; B01D 46/0034; B01D 2201/4069; B01D 35/06
USPC ..... 210/695, 167.03, 167.29, 222, 223; 209/38, 39, 40, 509, 562, 609, 220, 209/223.1, 226, 230, 232, 368, 478
See application file for complete search history.

(56) References Cited

U.S. PATENT DOCUMENTS 5,043,063 A * 8/1991 Latimer ..... B03C 1/284 210/222
5,188,239 A * 2/1993 Stowe ..... B03C 1/284 209/223.1
5,190,159 A 3/1993 Barker
5,819,949 A * 10/1998 Schaaf ..... B03C 1/284 209/223.2
6,077,333 A * 6/2000 Wolfs ..... B03C 1/28 210/222
8,132,674 B1 * 3/2012 Allore ..... B03C 1/0332 209/223.1
8,641,899 B2 2/2014 Branch
8,845,893 B2 * 9/2014 Marchand ..... B01D 35/06 210/222
2003/0173264 A1 * 9/2003 Yang ..... B03C 1/284 209/223.1
2005/0035030 A1 * 2/2005 Oder ..... B01D 35/06 209/232
2010/0065504 A1 3/2010 Yen et al.
2011/0186523 A1 * 8/2011 Williamson ..... B03C 1/30 210/695
2012/0051987 A1 * 3/2012 Johnson ..... B01L 9/06 422/562

FOREIGN PATENT DOCUMENTS

WO 0194022 A1 12/2001
WO 2009124342 A1 10/2009

* cited by examiner

DEVICE FOR CAPTURING AND REMOVING MAGNETIC MATERIAL IN A FLOW OF MATERIAL

BACKGROUND

The disclosure is related to a device for capturing and removing magnetic material in a flow of material, and more specifically related to a device which provides continuous capturing of unwanted magnetic material in a flow of material, while removing magnetic material.

It is known prior art solutions related to magnetized bars that are used to remove magnetic/metal material, such as metal cuttings, metal shavings, metal parts, and the like, in a flow of material, such as in a fluid stream of oil well drilling mud or flow of raw material. It is further known methods and apparatus for removing metal cuttings, metal shavings, metal parts captured by the magnetized bars by the use of a non-magnetic wiper assembly arranged slidable upon the magnetized bar between the ends thereof for removal of the captured metal from the magnetized bar.

Many of the metal parts that are collected by the magnetized bars, also known as ditch magnets, are pieces that have been cut or shaved and are thus of irregular shape and can have sharp edges/points, or the like. Safety is very important and meaningful in such operations including personnel handling equipment like this, especially in the oil and gas industry. Cuttings that are collected by a ditch magnet can include sharp edged debris that could possibly cut the hand of a worker who handles the ditch magnet.

Cuttings that have been retrieved from a ditch magnet can provide information that is beneficial to oil and gas well operators. These collected cuttings may indicate casing wear during ordinary drilling operations, pipe wear, or any other factor which could be used for economic or maintenance considerations.

In other industrial plants the supply of raw material includes unwanted microscopic foreign metal material or foreign metal bodies, in the form of metal fragments, screws, washers, or the like. Such unwanted metallic foreign contaminants are referred to as "tramp metals" in the industry. The presence of these metallic contaminants in the raw materials being processed in product-forming machines is undesirable for a variety of reasons. Contaminants may actually damage an industrial machine or render the finished part unusable or the presence of metal in the product may cause unacceptable structural, visual, or magnetic aberrations in the finished part.

Further, in the food industry, fish food industry or animal food industry also such equipment is favourable to use to detect unwanted metal material in the products.

Accordingly, the need for a device for removing unwanted metal material from a flow of material in many different areas, such as in oil well drilling mud, product-forming machines, granular handling equipment, and other plants (such as food) or processes where there is needed to remove metal material from a flow of material.

Different solutions have been proposed for providing methods and apparatus which are arranged for capturing unwanted metal material in a flow of material, and which at the same time should be easy to clean and simple to operate, which solutions will be discussed below.

U.S. Pat. No. 5,043,063 (Michael W. Latimer) discloses a magnetic trap made up of a hollow, generally cylindrical body, having an open top, an inlet and an outlet for connecting to a flow line for liquid containing entrained removable magnetic material. There is a removable cover for the hollow body, a plate is supported on the cover, and elongated, spaced non-magnetic tubes are fixed to the cover. Elongated stacks of permanent magnets are attached to the plate and extend through the cover into the tubes. When magnetic material held to the tubes by the magnets is to be removed, the cover can be removed from the body, the magnetic stacks can be pulled out of the non-magnetic tubes with the plate, thereby removing the magnetic fields from the tubes so that the magnetic material held to the tubes falls off of the tubes, thereby cleaning the tubes.

From U.S. Pat. No. 5,188,239 (Michael W. Stowe) it is disclosed a tramp metal separation device adapted to be removably inserted into a housing which directs pelletized raw material to an industrial machine and to separate tramp metal contaminants therefrom. A drawer frame having an outer face plate with a plurality of openings disposed therethrough is adapted to be removably inserted into the housing. A plurality of cylindrical magnets, adapted to be inserted through the plurality of openings in the outer face plate, is secured to a drawer plate. Described is also a plurality of silicon-based O-rings that may be disposed in grooves on the inner surface of the openings so as to form a wiper mechanism to aid in removing particles from the magnets.

U.S. Pat. No. 8,641,899 (James A. Branch) describes a method and apparatus for removing metal cuttings from an oil well drilling mud stream which provides a magnetic body or "ditch magnet" having end plates that extend radially and circumferentially from the magnetic body, the plates being positioned at end portions of the magnetic body. A third plate in the form of a wiper is used to dislodge metal cuttings and other metallic material from the magnetic body after the magnetic body has accumulated such metallic parts. One of the end plates can be removable to facilitate a complete scraping or wiping of the metallic parts from the metallic body by the wiper plate.

The above mentioned solutions suffer from that they will not provide a continues capturing of unwanted metal material, as the flow of material will need to be stopped at the time of cleaning of magnetic material in the magnets or the flow of material will be left without magnets at the time of cleaning. In e.g. a drilling operation there will be sufficient costs with stopping the drilling while the magnets are cleaned for metal material. Continuing the flow of material while the magnets are cleaned is usually not an option as this will result in that equipment could be damaged due there is no capturing of magnetic material.

There exists some solutions is arranged for continuous capturing, which will be discussed below.

WO 2009124342 describes magnetic separation apparatus for separating magnetic materials from non-magnetic materials in a material flow comprising self cleaning magnetic separators comprising: a cylinder having a first end closer to a material flow than its second end in use, a piston slidingly mounted within the cylinder, and a magnetic shaft extending from the piston, the piston and cylinder adapted to move the magnetic shaft between an extended position and a retracted position, such that in the extended position, at least a sleeveless portion of an outer surface of the magnetic shaft is exposed to the material flow and in the retracted position the magnetic portion is retracted substantially or wholly within the cylinder, the apparatus including a protected shaft wiper and shaft seal; within the first end of the cylinder for removing extracted magnetics. Accordingly, it is described an automatic solution where a piston and cylinder are used for retracting the magnetic shaft, which will be both complex and expensive to install and maintain. Further, it will not be suitable for use in capturing and removing metal cuttings from an oil well drilling mud stream onshore or offshore due to the harsh environment. This solution will also have a problem getting rid of the collected material. Further, the magnetic shafts are arranged in parallel in width direction and in the longitudinal direction, which will not be the most effective manner for capturing metal cuttings.

U.S. Pat. No. 8,132,674 B1 describes a device for magnetic separation of tramp metal, which consists of a first and a second housing. The first housing has an inlet and an outlet, a first drawer and a second drawer. Each of the drawers has a plurality of magnets and a wiper assembly for each of the magnets. The drawers are supported with respect to the first housing such that each of the drawer is moveable between an extended position and a retracted position. In the extended position, the magnets of the respective drawer is positioned within the first housing and are adapted to be in contact with the stream of raw materials. In the retracted position, the magnets of the respective drawer are positioned outside of the first housing. The drawers move independently of each other and the device is so constructed that one set of magnets is always in contact with the fluid, which requires cleaning. This solution also suffer from the disadvantages as mentioned above for WO 2009124342, but in addition this solution is arranged for arranging the magnets in the horizontal plane, which would be a severe problem if used in a oil well drilling mud stream onshore or offshore, and would require complex sealing means to avoid mud from leaving when a magnet is drawn out for cleaning.

U.S. Pat. No. 5,190,159 a reveals a device for magnetic separation and removing magnetic material from a fluid flow. The device comprises of arrays of magnet tubes, which are in contact with the fluid stream. Each magnet tube has a wiper assembly, which removes the attached magnetic particles when the arrays are retracted from the stream. The magnetic particles are deposited in a separate compartment. The arrays are retracted by handles and can be move independently of each other. It is shown in one of the Figures that the magnet tube may consist of a plurality of magnets segments indicating that a magnetic field with switched polarisation may be used, however there are now description of this leaving it unclear how this will work or the purpose of this. This solution also suffer from the disadvantages as mentioned above for WO 2009124342, but in addition this solution is arranged for arranging the magnets in the horizontal plane, which would be a severe problem if used in a an oil well drilling mud stream onshore or offshore, and would require complex sealing means to avoid mud from leaving when a magnet is drawn out for cleaning.

A further disadvantage with the three latter solutions is that they would need to be sufficiently displaced from each other to ensure that the magnetic force of each magnet does not affect an adjacent magnet as this will result in problems with withdrawing the magnets in an automated manner.

Another disadvantage with the latter solutions is that the use of automatic control will considerably increase the space needed for installation and use of the solutions.

SUMMARY

The present disclosure provides a device for capturing and removing magnetic material in a flow of material which solves the above mentioned drawbacks of prior art.

Also provided herein is a device for capturing and removing magnetic material in a flow of material which provides continuous collection of magnetic materials while removing and cleaning.

The disclosure further provides a device for capturing and removing magnetic material in a flow of material where one or more sets of magnet rods are arranged to provide a magnet grid providing the best possible magnetic field over the area which the material is flowing through the device.

Also provided is a device for capturing and removing magnetic material in a flow of material where two or more magnet rods are arranged together to form a set of magnet rods of magnet assembly and where the magnet assembly is arranged in a sliding system for easy insertion and removing from the device.

Also provided is a device for capturing and removing magnetic material in a flow of material including several rows of magnet assemblies spaced apart in the flow direction of the material to enable continuous capturing of magnetic material.

Also provided is a device for capturing and removing magnetic material in a flow of material which provides efficient and safe cleaning of the magnet assemblies for personnel during continuous flow of material (production), so that one do not need to stop the flow of material (production) during cleaning of the magnet assemblies for captured metal material.

Also provided by the disclosure is a device for capturing and removing magnetic material in a flow of material which has low weight and can be handled in an easy way by a single person and which satisfies the requirements of HES (Health, Environment and Safety).

The disclosure also provides a device for capturing and removing magnetic material in a flow of material which satisfies the requirements of explosion hazard environments.

The disclosure also provides a device for capturing and removing magnetic material in a flow of material which can easily be adapted to new and existing system, and at the same time be space saving.

The disclosure also provides a device for capturing and removing magnetic material in a flow of material which can easily be extended by adding additional modules including magnet assemblies.

Further embodiments and characteristics will appear from considering the following description, drawings and claims.

A device for capturing and removing magnetic material from a flow of material, according to the disclosed embodiments includes magnet assemblies formed by a set of magnet rods including at least two magnet rods arranged together at upper end by means of a magnet handle device and at the lower end by means of a magnet guider. Flow of material does herein mean a material in a condition able to flow through the device according to the disclosure, such as fluids, raw material and so on. The magnet rods are further enclosed in a non-magnetic material, such as a sleeve or an encapsulating non-magnetic material, as well known for a skilled person. The magnet assembly is further provided with non-magnetic end areas of the magnet rods. The magnet rods can include permanent magnets or controllable magnets, depending on the area of use. In e.g. explosion hazard areas where there are possibilities for gas being present, such as on offshore installations, permanent magnet rods will be used to avoid possibilities for sparks which could set gas on fire.

The magnet handle device is formed by a fixing plate for fixation of the magnet rods upper end and a handle for easy carrying and handling.

The magnet assembly further includes a wiper assembly being movably arranged to the magnet rods, between the upper magnet handle device and lower magnet guider.

The shape of the handle bar, together with the handle bar guides in the frame, prevents the opportunity for incorrect mounting of the magnet rods during maintenance, interrupting the optimized calculated magnetic field setup of the assembly.

The disclosed device further includes a frame assembly for arrangement of the magnet assemblies to form a defined magnet grid assembly. The frame assembly includes a mainly U-shaped frame where an upper plate is arranged in transversal direction between the legs of the U-shaped frame.

Further, the upper plate and bottom of the U-shaped frame are provided with corresponding holes for receiving the above described magnet assemblies.

Further, between the holes of the upper plate and bottom of the U-shaped frame, a sliding system for accurate positioning and fixation of the magnet assemblies are arranged. The sliding system consists of mainly U-shaped guiding bars for guiding and holding the magnet assemblies in place in the U-shaped frame.

The U-shaped guiding bars are preferably arranged such that the opening thereof is facing along the flow of material, and in this way the bottom of the U-shaped guiding bars act as a protection for the magnet assemblies arranged therein, and also ensures that the magnet bars do not bend during insertion and removal. The sliding system is further necessary to make it possible to insert or remove the magnet assemblies when the flow of material is continuous.

Depending on how many magnet assemblies to be arranged in the transversal direction of the U-shaped frame, the upper plate and bottom of the U-shaped frame will be provided with holes and guiding bars such that the magnet assemblies are evenly distributed over the cross-sectional area of the U-shaped frame, which defines the area where the material flows through the device.

Accordingly, the magnet assemblies and the frame assembly together form a module for the device. The device can thus easily be adapted to include several modules like this, and where the device at least includes two modules like this, further explained below.

As mentioned the magnetic assemblies includes a set including at least two magnet rods, and the magnet assemblies are further arranged in the U-shaped frame such that the sets of magnet rods form a magnet grid where the at least two magnet rods of each set are displaced in transversal and longitudinal direction of the frame assembly and in relation to each other, seen in the flow direction of the material. E.g. this is achieved by that the holes and guiding bars the magnet assemblies are arranged to position the magnet assemblies in a direction deviating from the longitudinal or transversal direction of the U-shaped frame and upper plate. By this can be achieved a magnet grid, where the magnet rods of the sets are not positioned on the same line, but positioned to provide a magnetic grid providing a stronger magnetic field over an area of the frame assembly.

Further, the guiding bars will result in turbulence behind them, seen in the material flow direction, which improves the effect of the magnet rods, resulting in higher efficiency and more captured unwanted metal material. Reference is made to FIGS. 5*a-d*, where FIGS. 5*a-b* show a simulation of a inlet and outlet flow, respectively, through a section of the disclosed device where the guiding bars are present, and FIGS. 5*c-d* which show simulation of inlet and outlet flow, respectively, through a section of the disclosed device without the presence of the guiding bars. The U-shaped guiding bars are placed in a calculated pattern so they interrupt the laminate flow through the circular magnet grid by creating a vortex of flow near the magnets together with a sharp change of flow direction, using the pendulum gravity from this change of direction to throw heavier particles to the base of the magnetic field of each magnet rod. Accordingly, the guiding bars in the disclosed device also have an important function as flow breakers, which substantially increase the performance of the magnets.

The magnet rods of each set are arranged with switched polarisation at any horizontal section, creating a magnetic field working together between the separate magnet rods of each set and magnet rods of neighbouring sets of magnet rods. Like vice each magnet rod is divided in at least two vertical magnet segments inside the rod with opposite polarisation, creating the same effect vertically on the magnet rod. This creates a cross web of magnetic field on both the horizontal and vertical section of the set of magnet rods and between magnet rods of neighbouring sets of magnet rods.

The small diameter of the magnet rods, together with the calculated pattern of magnet rods and flow breakers, decreases the speed of flow through the magnetic grid, without significantly increasing the pressure drop through the magnetic grid assembly.

The small diameter of the magnet rods gives the opportunity to customize by magnetic field calculation and simulation, the setup of the magnetic field optimized for efficiency, pressure drop or magnetic field intensity based on the flow media.

The assembly can be equipped with sensors measuring the difference in height of the fluid on both sides of the magnetic grid assembly, indicating the pressure drop over the assembly, trigging an alarm for magnetic filter cleaning.

According to a further embodiment of the disclosure, the device includes at least two modules as described above, positioned in series in the flow direction to provide at least two separate rows of magnet assemblies, seen in the material flow direction. It should be mentioned that the U-shaped frame also could consist of one U-shaped frame and upper plate being arranged to receive at least two separate rows of magnet assemblies. By this is achieved that one can clean the first row or second row etc. while the other row of magnet assemblies continuously performs capturing of magnetic material. By this is achieved that there will be no need for stopping the material flow or leaving the material flow unprotected when cleaning.

The number of magnet rods per set in the magnet assembly, the number of magnet assemblies per row, the number of rows of magnet assemblies, as well as the number of vertical magnet segments inside the magnet rod and polarisation of each magnet segment can easily be adapted to the actual application. Usually one will use magnet rods/magnet segments being as strong as possible, but e.g. in applications where other equipment close to the disclosed device will be sensitive for magnetic field, the device can include less strong magnet rods/magnet segments and more of them either in transversal direction, i.e. per row, or more rows of magnet assemblies or higher number of vertical magnet segments. With the inclusion of modules, the disclosed device can be tailored to the available space in the application where it is to be used.

The device disclosed herein will be arranged in a flow line for material, such as a fluid line or raw material flow line offshore or onshore or in industrial plants, and the magnet assemblies are arranged to be inserted and removed in a vertical direction upwards from the flow of material, i.e. not from the sides of the flow of the material.

Another feature of the disclosed device is that the magnet assemblies are easy to remove and insert. When there is a need for cleaning, the separate magnet assembly can easily be removed from the frame assembly while remaining rows of magnet assemblies continue the capturing of magnetic material. By means of the device including a wiper assembly, the captured magnetic material can easily be removed by moving the wiper assembly between the upper magnet handle device and lower magnet guider. As the magnet rods at the lower end are free of magnets, total removal of the magnetic material is achieved in an easy way. After the cleaning process is performed, the magnet assembly again is inserted in the guiding bars and safely inserted into the frame assembly, whereupon the next magnet assembly can be cleaned. The functionality of the guiding bars will be essential to allow the magnet assembly to be inserted again after removal when the material flows continuously, as the flow will otherwise affect the magnet assembly and it will be difficult for the operating person to arrange the magnet assembly again in the holes of the bottom of the U-shaped frame.

Depending of the application the flow velocity of the material can be reduced or increased in front of the device.

With the disclosed embodiments, one can also arrange means in front of the device for measuring the material level, which could be used to detect when the magnet assemblies should be cleaned. When the material level has increased above a certain level, this will indicate that the material flow through the device is low and that the magnet assemblies should be cleaned.

The magnet assemblies of the device can include sets of permanent magnet rods or controllable magnet rods which can be switched on and off, or even controllable magnet rods where one can control the properties/effect thereof by means of a control device arranged for this.

BRIEF DESCRIPTION OF THE DRAWINGS

The present invention will below be described in further detail with reference to the attached drawings, where.

DETAILED DESCRIPTION

Figure 1A:
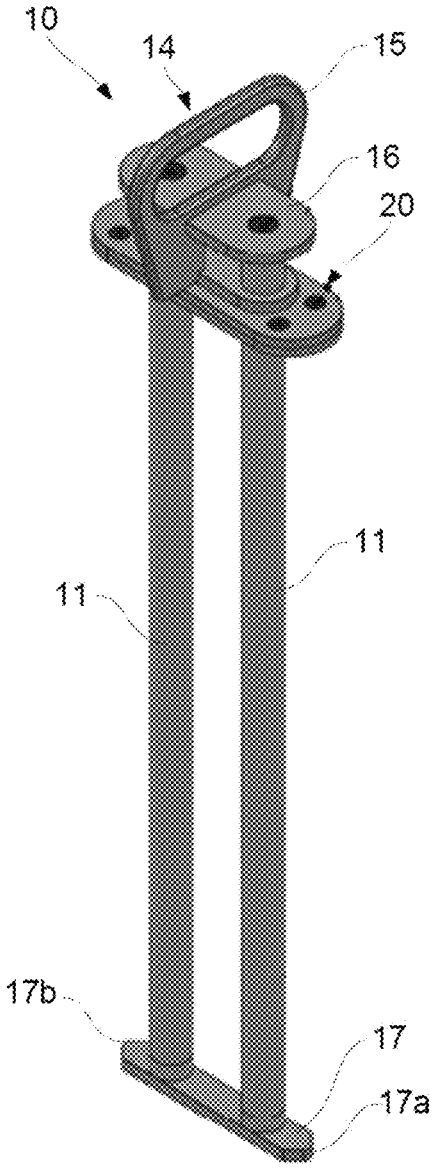
FIG. 1*a* is a principle drawings of magnet assemblies according to the disclosure.
Figure 1B:
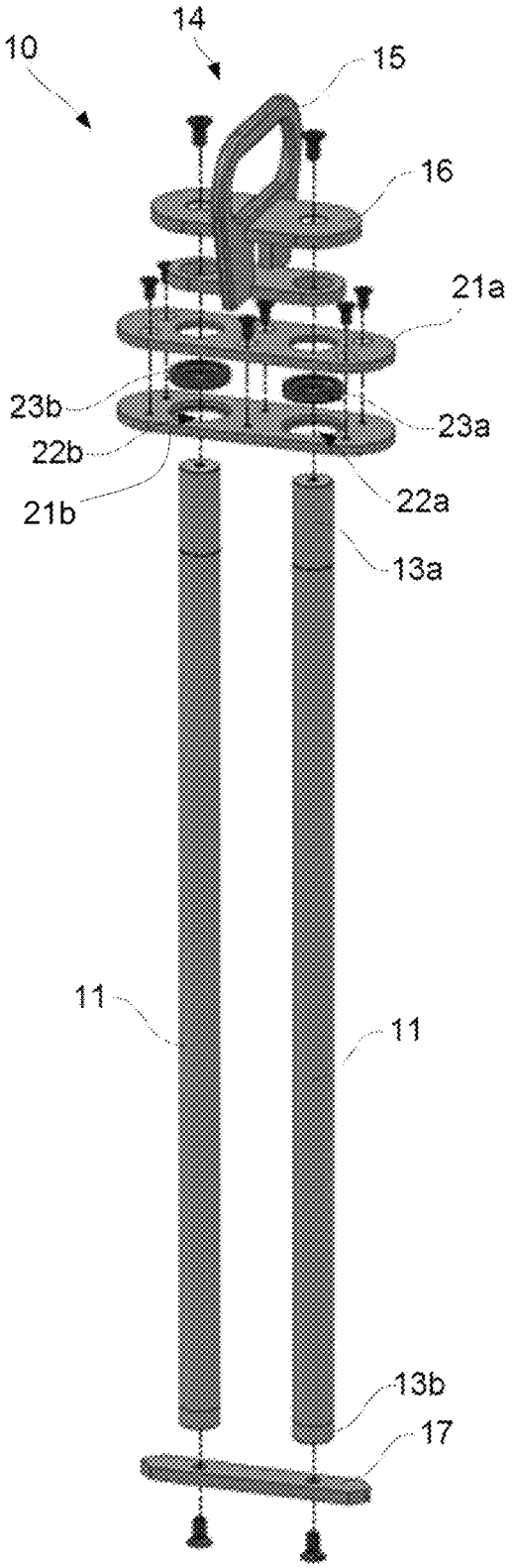
FIG. 1*b* is an exploded view of the magnet assemblies of FIG. 1*a*, FIGS. 2*a*-2*d* are principle drawings of sets of magnet rods containing magnet segments with different polarisation, as well as showing magnetic field created thereby.

Reference is now made to FIG. 1*a*-*b* showing principle drawings of a magnet assembly 10 for a device 100, where FIG. 1*b* is an exploded view showing further details. The magnet assembly 10 according to the exemplary embodiment includes at a set of at least two magnet rods 11 in the form of permanent magnets, enclosed in a non-magnetic sleeve 11*a* or material, and where upper and lower ends 13*a*, 13*b* thereof do not contain magnets. Even if permanent magnet rods 11 hereafter will be used as the example, this does not limit the invention as also other magnet rods can be used, such as controllable magnet rods. The permanent magnet rods 11 are at upper end fixed to a magnet handle device 14 formed by a handle 15 and a fixation plate 16 having a mainly elliptic shape. At the lower end the permanent magnet rods 11 are fixed to a magnet guider 17 having a mainly elliptic shape with tapering distal ends 17*a*-*b*.

The magnet assembly 10 further includes a wiper assembly 20 formed by upper and lower scraper bodies 21*a* and 21*b* having a mainly elliptic shape provided with through holes 22*a*-*b* for accommodating the permanent magnet rods 11. Between the scraper bodies 21*a*-*b* and in connection with the through holes 22*a*-*b* are arranged metal wipers 23*a*-*b* of non-magnetic material, one for each permanent magnet rod 11, which metal wipers 23*a*-*b* having a central opening adapted to outer surface of the permanent magnet rods 11. In this way the metal wipers 23*a*-*b* are movably arranged along the permanent magnet rods 11 by means of the scraper bodies 21*a*-*b*.

Figure 2A:
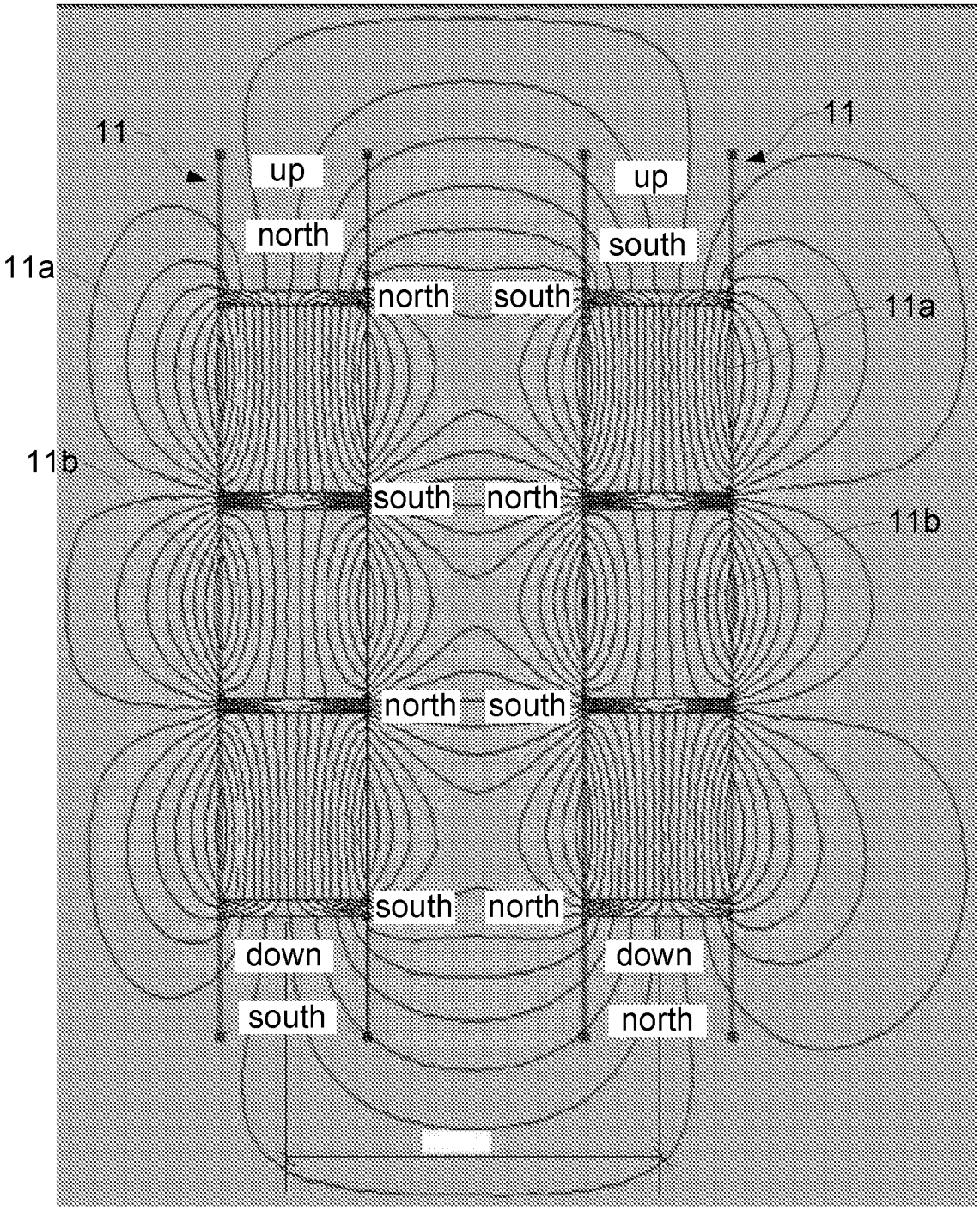
Figure 2B:
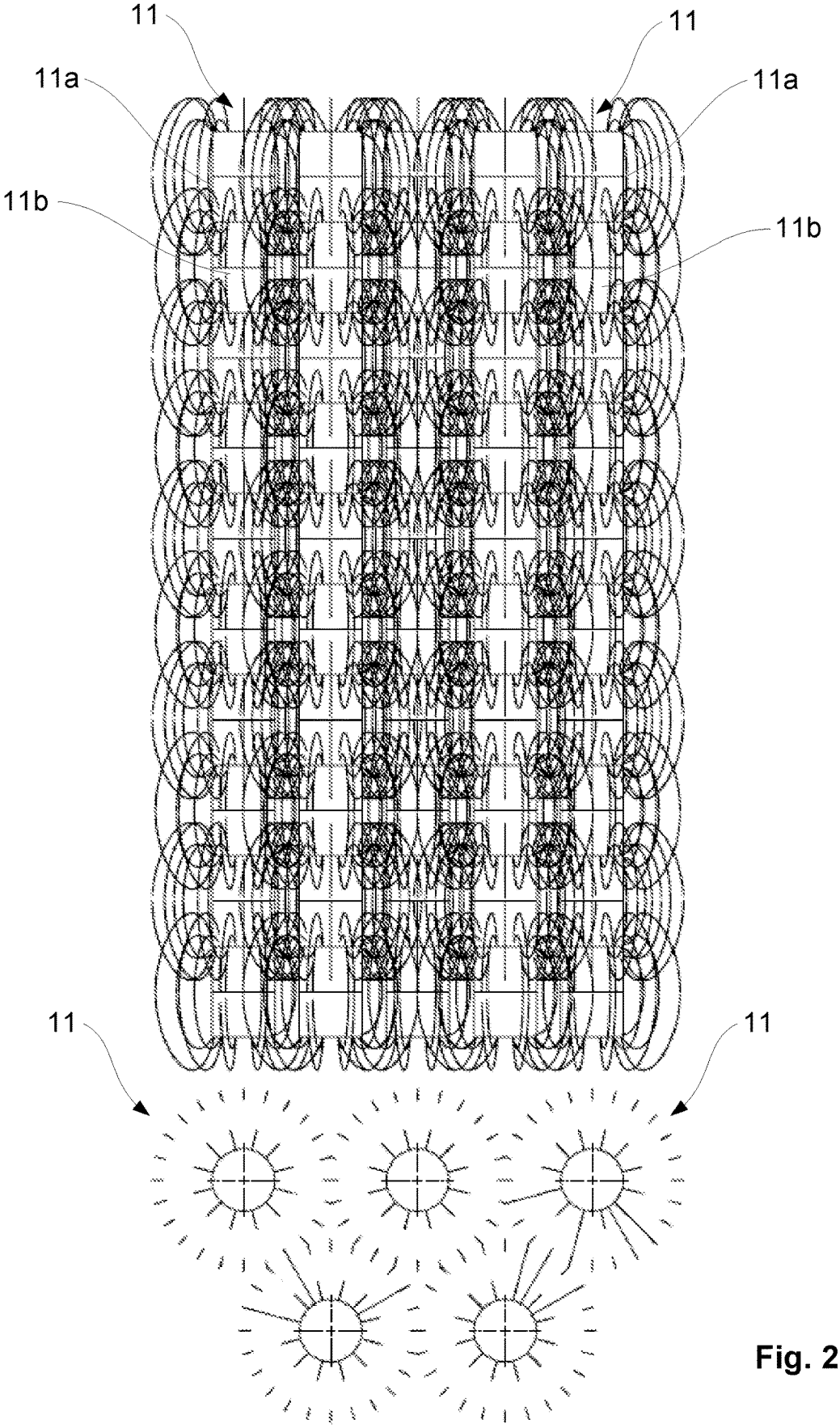
Figure 2C:
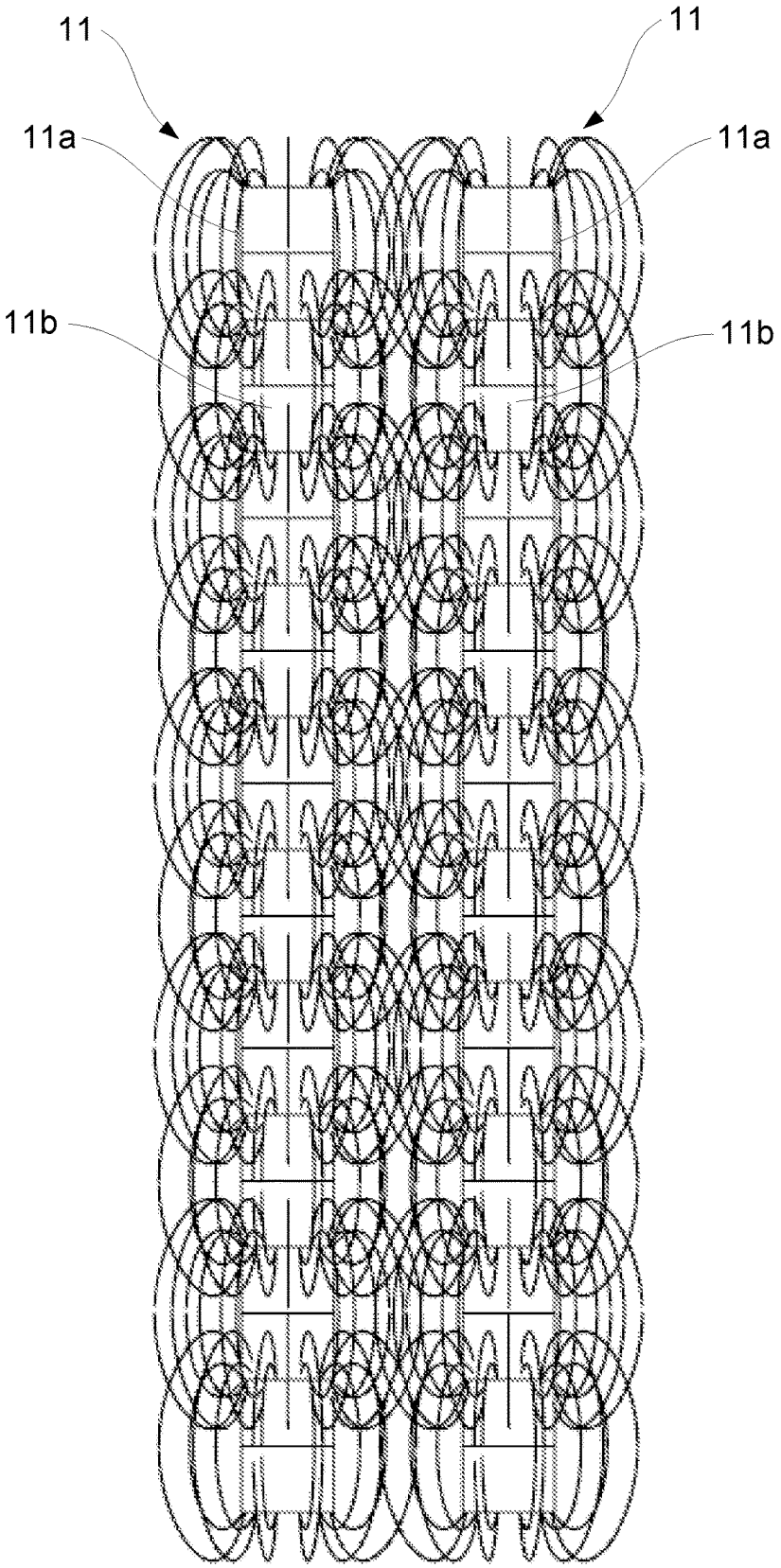
Figure 2D:
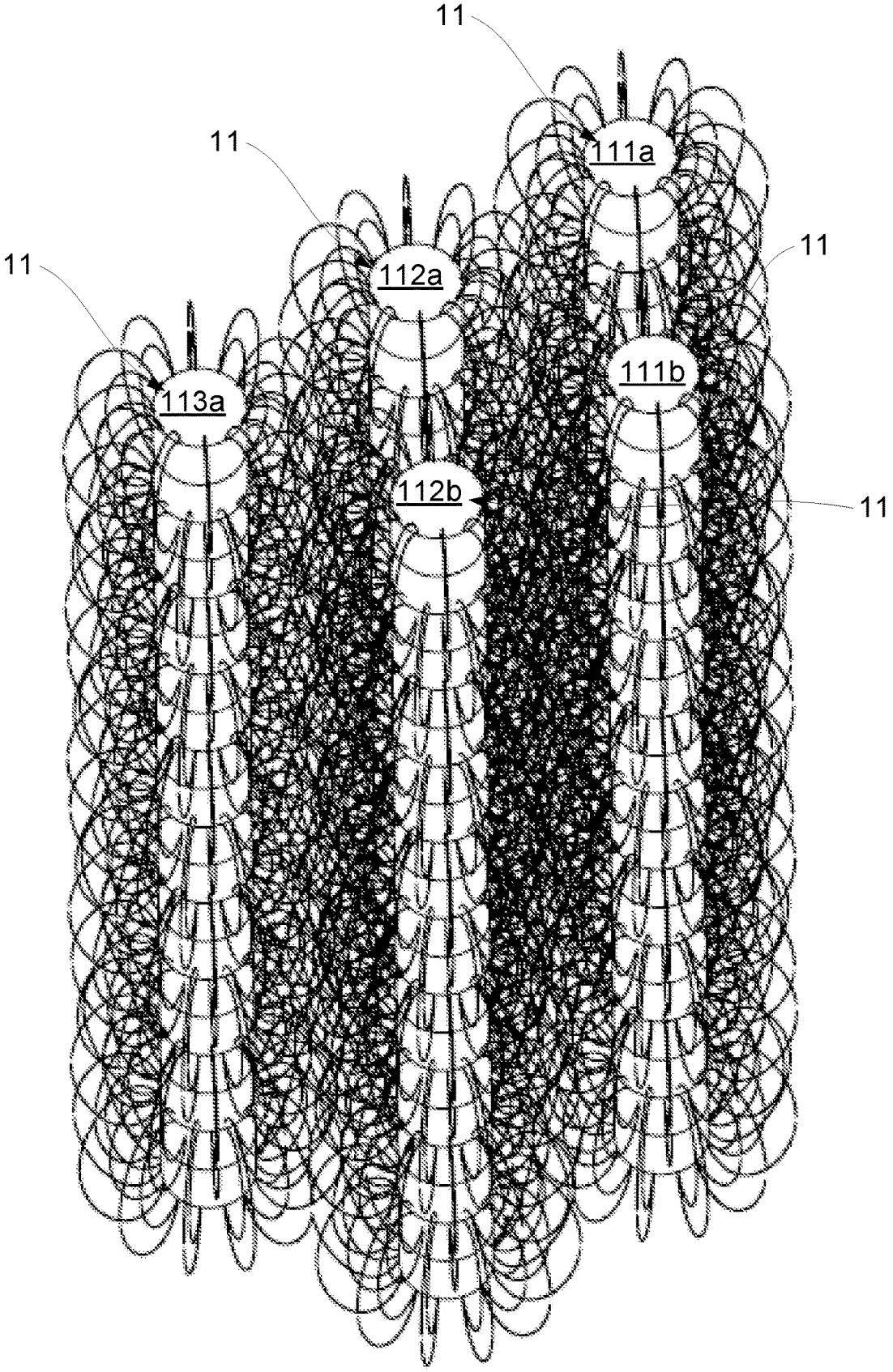

Reference is now made to FIGS. 2*a*-*d* which shows principle drawings of interaction between permanent magnet rods 11 in a set 111*a*-*b*, 112*a*-*b*, i.e. a magnet assembly 10, and between neighbouring sets 111*a*-*b*, 112*a*-*b*, 113 of permanent magnet rods 11. In the example shown in FIG. 2*a* there are shown a set of two permanent magnet rods 11 of a magnet assembly 10, each magnet rod 11 containing e.g. four magnet segments 11*b* with opposite polarisation. In the shown example in FIG. 2*a*, the magnet rod 11 at the left side includes magnet segments 11*b* with north up and south down, while the magnet rod 11 at the right side includes magnet segments 11*b* with south up and north down, seen in the longitudinal direction of the magnet rods 11. By the use of magnet rods 11 formed by at least two magnet segments 11*b*, in the example permanent magnets, the sets of magnet rods 11 can be arranged in a frame assembly 30 (FIG. 3) with switched polarisation at any horizontal section, creating a magnetic field working together between the separate magnet rods 11 in each set, as well as between magnet rods 11 of neighbouring sets, as shown in FIGS. 2*b* and 2*d*. As the magnet rods 11 are divided in at least two vertical magnet segments 11*b*, with opposite polarisation, this will create the same effect vertically on the magnet rod 11. By this is achieved the creation of a cross web of magnetic field on both the horizontal and vertical section of set of magnet rods 11 of the magnet assembly 10, as well as between magnet rods 11 of neighbouring sets 111*a*-*b*, 112*a*-*b*, 113, as can been seen from FIGS. 2*b* and 2*d*. In FIGS. 2*b* and 2*d* there are shown two sets 111*a*-*b* and 112*a*-*b* formed by two magnet rods 11, a magnet rod 113*a* of a third set, and the sets 111*a*-*b*, 112*a*-*b* and 113*a* being spaced apart in transversal direction of the flow direction of the material, and the sets 111*a*-*b*, 112*a*-*b*, 113*a* of magnet rods 11 are arranged so that they deviate from the flow direction with an angle, i.e. the second magnet rod 11 of each set 111*a*-*b*, 112*a*-*b* is displaced both in longitudinal direction and transversal direction in relation to the first magnet rod 11 of the set 111*a*-*b*, 112*a*-*b*. In this way the mentioned sets 111*a*-*b*, 112*a*-*b*, 113*a* of magnet rods 11 form a magnetic grid with an extension both in the horizontal and vertical plane. As can be seen from the magnetic field lines in Figures the magnet rods 11 of each set 111*a*-*b*, 112*a*-*b*, 113 create magnetic fields therebetween, but also magnetic fields are created between magnet rods 11 of neighbouring sets 111*a*-*b*, 112*a*-*b*, 113*a*. This way of arranging sets of magnet rods 11 are not known from prior art.

Figure 3A:
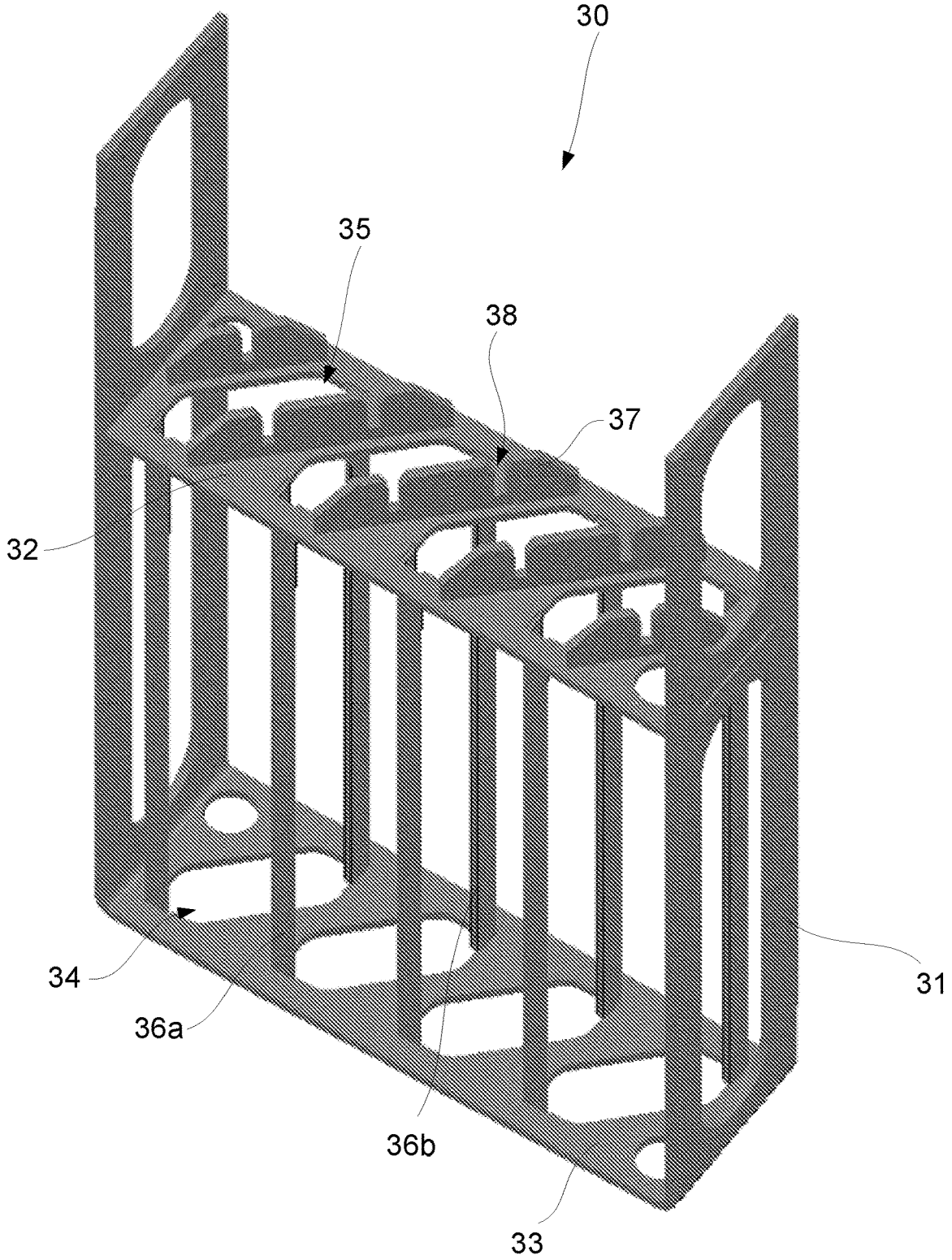
FIG. 3*a* shows a frame assembly for the magnet assemblies of FIGS. 1*a* and 1*b*.

Reference is now made to FIG. 3*a* which is a principle drawing of a frame assembly 30 for the magnet assemblies 10 shown in FIG. 1. The frame assembly 30 is formed by a mainly U-shaped frame 31 and an upper plate 32 fixed between the legs of the U-shaped frame 31. Bottom 33 of the U-shaped frame 30 preferably exhibits a rectangular cross-section corresponding to the upper plate 32 and is further provided with mainly elliptic shaped holes 34 with tapering distal ends for receiving the magnet guider 17 of the permanent magnet assembly 10. The upper plate 32 is further provided with corresponding mainly elliptic holes 35 with tapering distal ends for receiving the permanent magnet assembly 10 and the shape and size of the wiper assembly 20 is larger than the elliptic holes 35, so that the scraper bodies 21*a-b* works as a stopper for the permanent magnet assembly 10 in vertical direction after insertion into the holes 34, 35.

Between the holes 34 of the bottom 33 of the U-shaped frame 31 and the holes 35 of the upper plate 35 there are arranged pairs of U-shaped guiding bars 36*a-b*, arranged at the tapering distal ends of the holes 34, 35, which guiding bars 36*a-b* are arranged for guiding and retaining the permanent magnet assemblies 10 by that the openings of the U-shaped bars 36*a-b* are arranged facing each other.

The frame assembly 30 is further at the upper side of the upper plate 32 provided with perpendicularly projecting flanges 37, arranged on both sides of the holes 35, which flanges 37 are provided with recesses 38 adapted for receiving and retaining the handle 15 of the permanent magnetic assembly 10.

In this way the permanent magnet assemblies 10, when inserted into the holes 34, 35 and guiding bars 36*a-b*, and the handle 15 is secured in the recesses 38, the permanent magnet assemblies 10 will be locked for movement in any direction as a consequence of a material flowing past the permanent magnet rods 11.

The holes 35 and 34 of the upper plate 32 and bottom 33, respectively, are further arranged so that they extend in a direction between longitudinal sides of the upper plate 32 and bottom 33, respectively, with an angle deviating from a straight line between the longitudinal sides, for in this way to position the sets of at least two permanent magnet rods 11 of a permanent magnet assembly 10 in a fixed position in the frame assembly 30, and so that the permanent magnet rods 11 are displaced both in longitudinal direction and transversal direction in relation to the frame assembly 30. In this way the permanent magnet assemblies 10, when arranged in the frame assembly 30 will form magnet grids of permanent magnet rods 11 being displaced in lateral and transversal direction in relation to each other, as well as in relation to the flow direction of the material. With the shown example where each permanent magnet assemblies 10 includes a set of two permanent magnet rods 11, a magnet grid of two rows of permanent magnets will be provided, where the first and second row of permanent magnets are displaced in relation to each other both in transversal and longitudinal direction of the frame assembly 30. If the permanent magnet assembly 10 includes a set of three permanent magnet rods 11, three rows of permanent magnet rods 11 will be provided per magnet assembly 10, and so on.

It should be noted, that the distance between the respective permanent magnet rods 11 of a set in a permanent magnet assembly 10, and the distance between the respective permanent magnet assemblies 10 will be dependent on the properties of the permanent magnets in the permanent magnet rods 11.

Figure 3B:
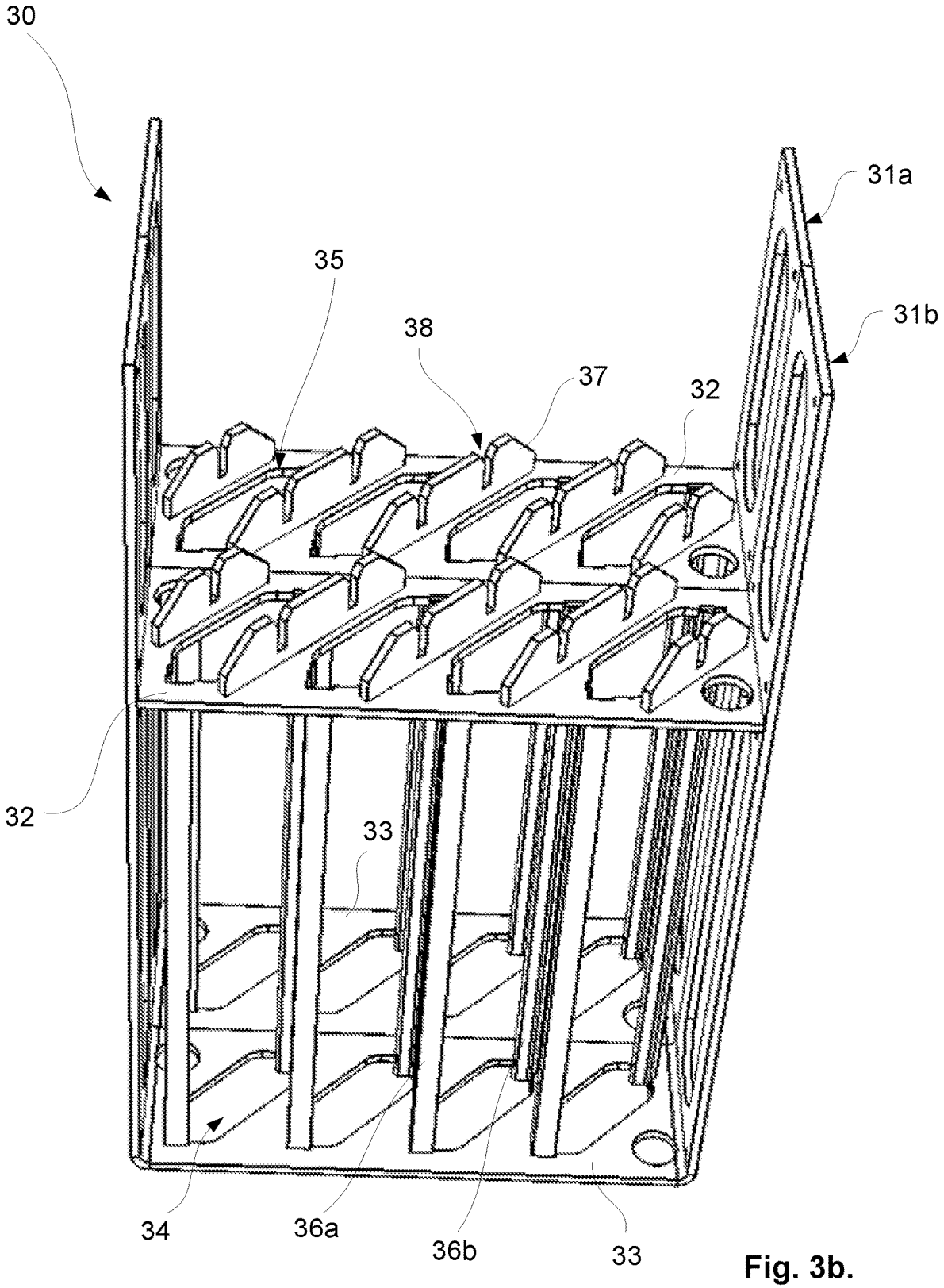
FIG. 3*b* shows a frame assembly for magnet assemblies of FIGS. 1*a* and 1*b*.

Reference is now made to FIG. 3*b* which shows an example of two U-shaped frames 31*a* and 31*b*, as described above, arranged together to form a frame assembly 30 arranged for receiving two rows of permanent magnet assemblies 10. Accordingly, if each permanent magnet assembly 10 includes a set of two permanent magnet rods 11, there will be provided two magnet grids as described above arranged in series.

Figure 4:
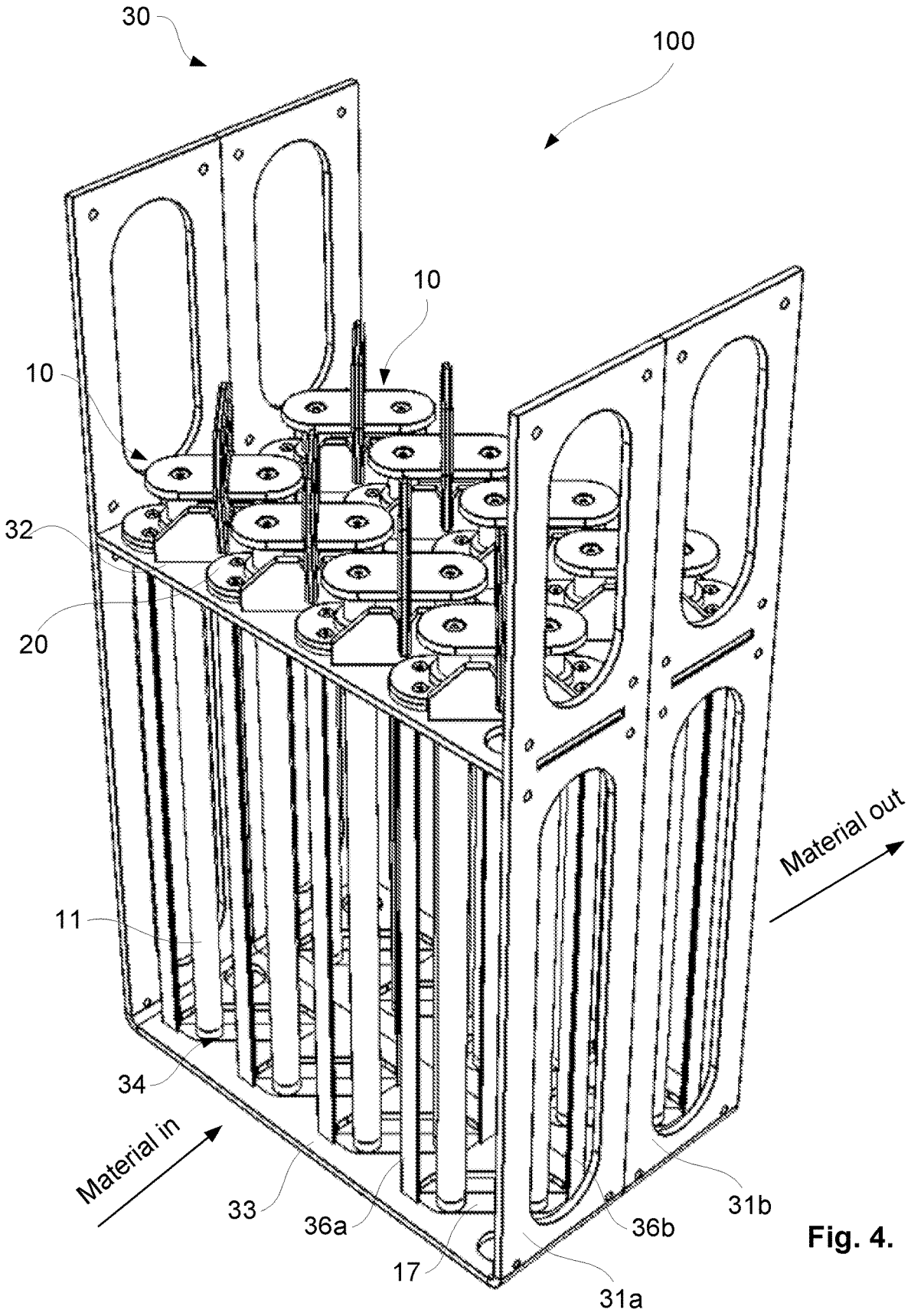
FIG. 4 is a principle drawing of a complete device according to the disclosure.

Reference is now made to FIG. 4 which is a principle drawing of a complete device 100 for capturing and removing magnetic material from a flow of material. In the shown example the frame assembly 30 consists of two frames 31*a-b* arranged together, and each frame 31*a-b* is provided with four permanent magnet assemblies 10, and where each permanent magnet assembly 10 is provided with a set of two permanent magnet rods 11. By the device 100 according to the disclosure it is provided a device 100 being easily scalable by adding frame assemblies 30 provided with permanent magnet assemblies 10, which can be adapted and arranged in a material flow line where material flows where it is desired to remove unwanted metal material from the flow of material. By that the device 100 according to the disclosure preferably includes at least two rows of permanent magnet assemblies 10 is achieved a solution where the operation can be continued, i.e. the flow of material do not need to be stopped during cleaning/removing of magnetic material from the permanent magnet assemblies 10, as the first row can be cleaned while the second row continues to capture unwanted metal material. By that the rows of permanent magnet assemblies 10 further is divided in several permanent magnet assemblies 10 one at all time ensures high effect on capturing unwanted magnetic material, as only parts (one permanent magnet assembly 10) is removed at time for cleaning, leaving the remaining permanent magnet assemblies 10 in the device for capturing magnetic material. Further, by means of the arrangement of at least two rows of permanent magnet assemblies 10 there will be no area left uncovered of permanent magnet rods 10, ensuring that the device 100 will at all time capture unwanted magnetic material.

Figure 5A:
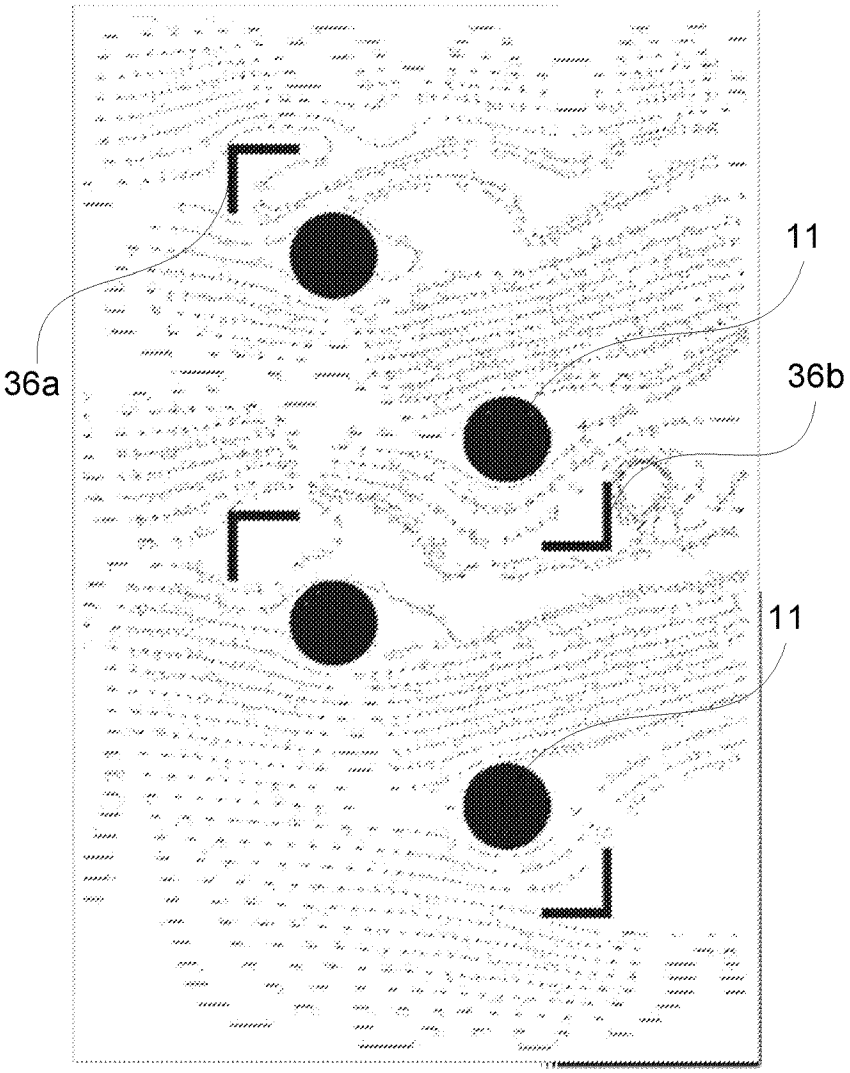
FIG. 5*a*-5*d* show simulation of flow through a section of a magnet assembly according to the disclosure, with and without flow breakers.
Figure 5B:
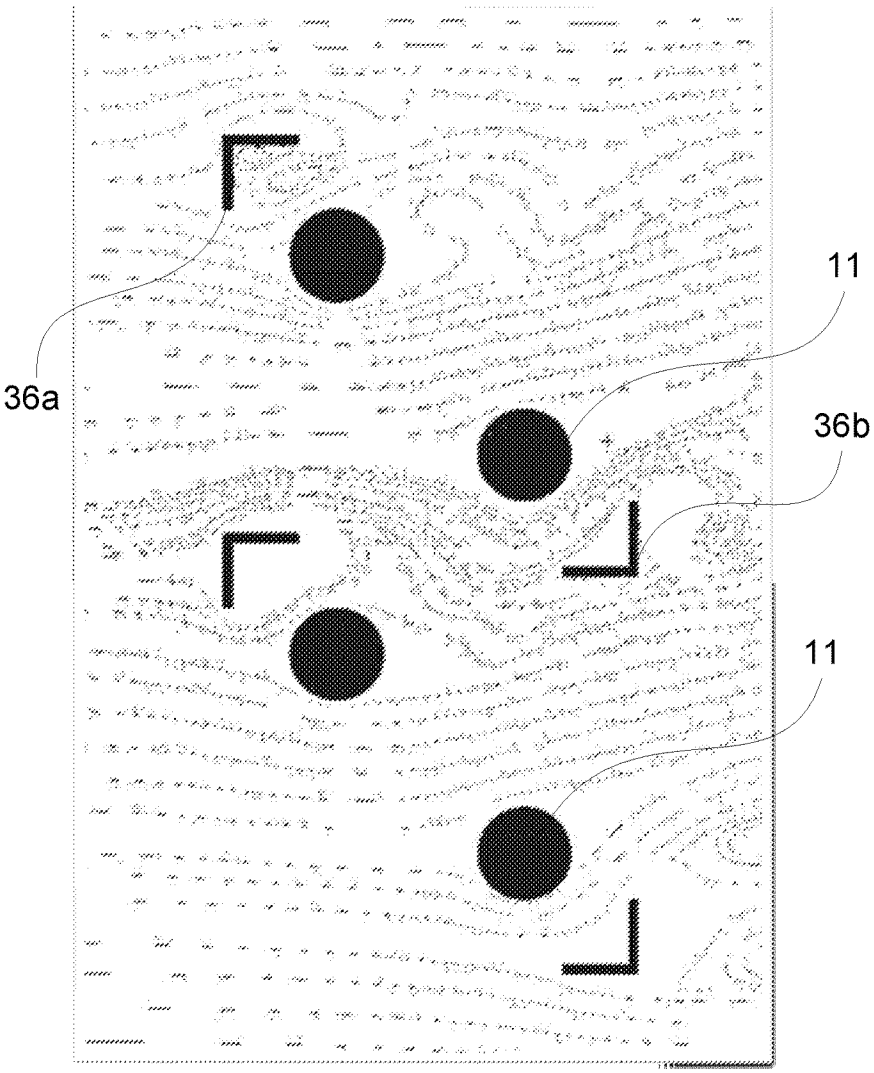
Figure 5C:
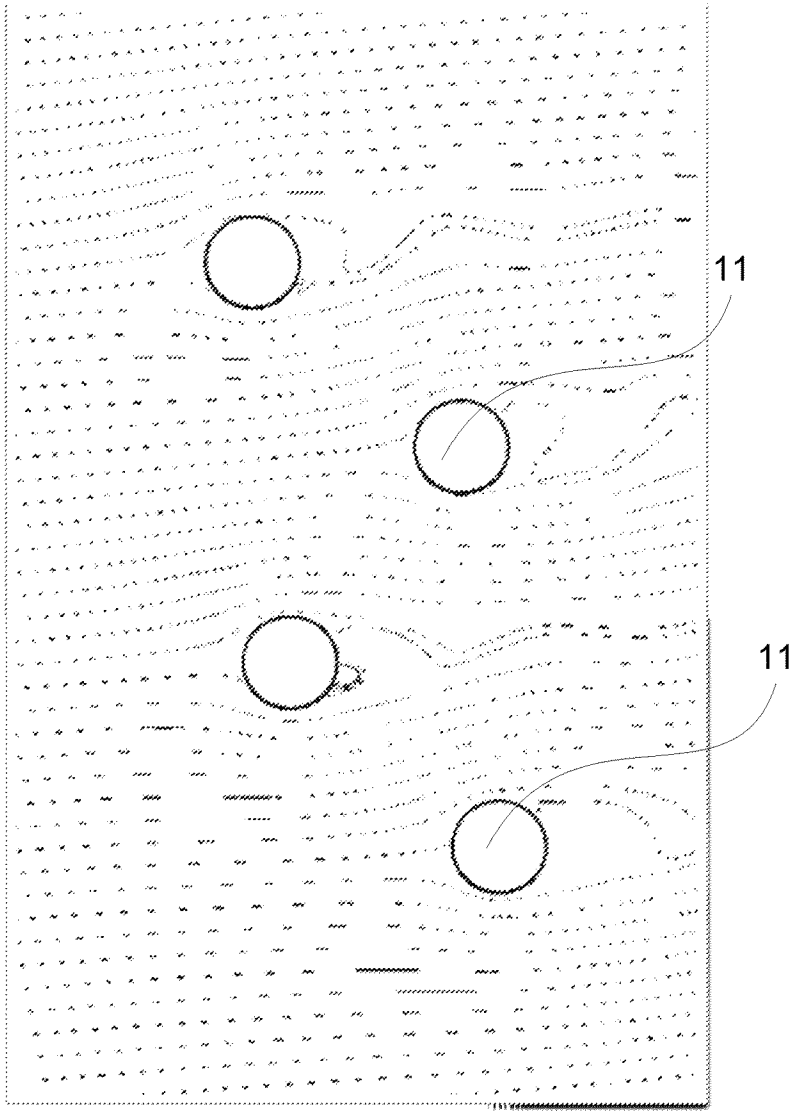
Figure 5D:
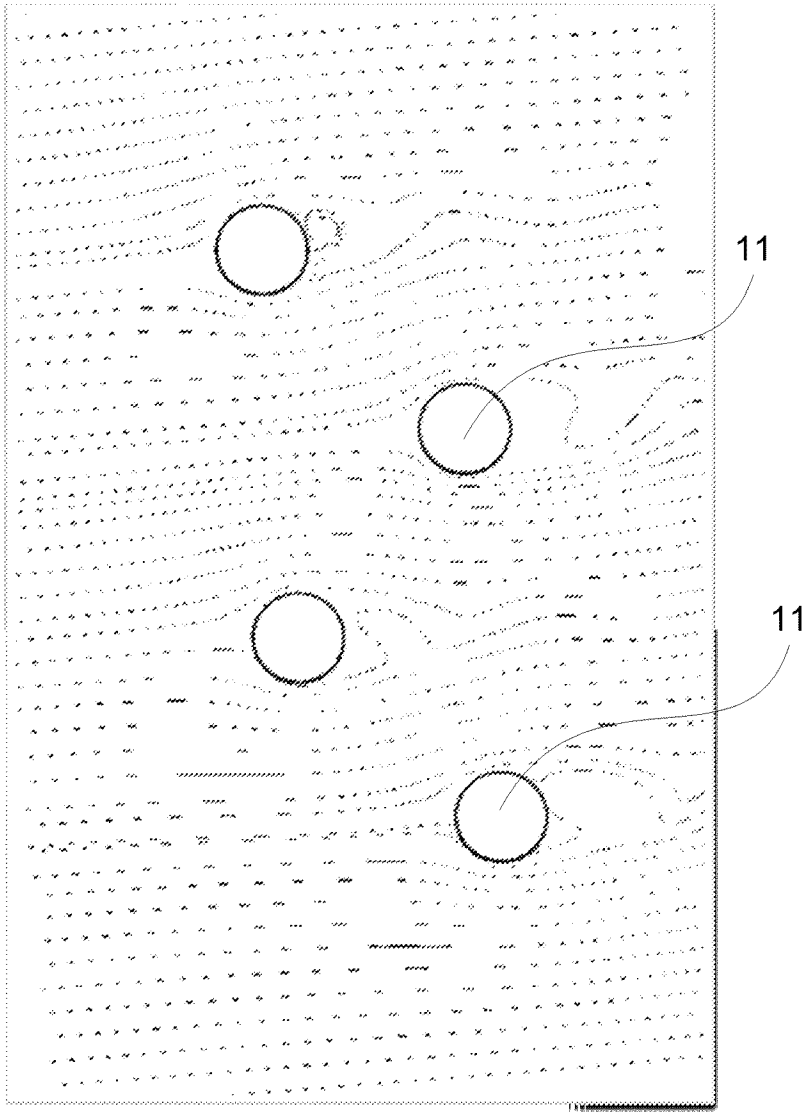

It is further achieved a device 100 where the permanent magnet assemblies 10 are easily insertable and removable from the frame assembly 30 by means of the guiding rods 36*a-b* which ensures correct insertion and removing of the permanent magnet assemblies 10. The guiding bars 36*a-b* is further arranged for decreasing speed of material flow through the device (100, and creating turbulence behind them, without significantly increasing pressure drop through the device 100, as shown in FIG. 5*a-b*.

It is further achieved a device 100 where the permanent magnet assemblies 10 are easy handable due to the limited number of permanent magnet rods 11 which make them handable for a single person. By this the low weight requirements according to HES (Health, Environment and Safety) are fulfilled.

By that the permanent magnet assemblies 10 are provided with a wiper assembly 20, the captured unwanted metal material can easily be removed from the permanent magnet assemblies 10 by a single person moving the wiper assembly 20 from the handle device 14 and down to the end of the permanent magnet assemblies 10 and back to the handle device 14.

The disclosed embodiments are especially suitable for capturing and removing metal cuttings from an oil well drilling mud stream onshore or offshore, metal material in a flow of raw material, process lines in food industry (animal, fish and human food) and also recovery or recycling plants, etc.

The invention claimed is:

1. A device (100) for capturing and removing magnetic material from a flow of material, comprising magnet assemblies (10) including magnet rods (11) for capturing magnetic material in a flow of the material passing the magnet assemblies (10), the magnet assemblies (10) being removably arranged to a frame assembly (30) of the device (100), wherein the frame assembly (30) comprises a bottom (33), an upper plate (32), and pairs of guiding bars (36*a-b*), wherein the upper plate (32) is opposite the bottom (33), wherein the bottom (33) and the upper plate (32) include at least two corresponding holes (34, 35) for receiving the magnet assemblies (10), wherein the magnet rods (11) are configured to extend between the corresponding holes (34, 35), wherein the pairs of guiding bars (36*a-b*) extend between the corresponding holes (34, 35), and wherein the pairs of guiding bars (36*a-b*) are at distal ends of the corresponding holes (34, 35), and wherein the pairs of guiding bars (36*a-b*) are adapted to receive a magnet guider (17) of the magnet assemblies (10) each magnet assembly (10) including a set (111*a-b*, 112*a-b*, 113*a*) of at least two magnet rods (11) encapsulated in a non-magnetic material (11*a*), wherein:

the at least two magnet rods (11) of each set (111*a-b*, 112*a-b*, 113*a*) are spaced both in a longitudinal direction and a transversal direction in relation to each other and in relation to a flow direction of the material, wherein the longitudinal direction is substantially perpendicular to the flow direction of the material, wherein the transversal direction is substantially perpendicular to the longitudinal direction, and wherein the magnet rods (11) of adjacent sets (111*a-b*, 112*a-b*, 113*a*) of magnet rods (11) are configured to be spaced apart in the transversal direction in relation to the flow direction of the material, the at least two magnet rods (11) of each set (111*a-b*, 112*a-b*, 113*a*) are arranged with switched polarisation at any horizontal section, thereby creating a magnetic field working together between separate magnet rods (11) of each set (111*a-b*, 112*a-b*, 113*a*) and between magnet rods (11) of neighbouring sets (111*a-b*, 112*a-b*, 113*a*) of magnet rods (11), and the magnet rods (11) are divided in at least two vertical magnet segments (11*b*) with switched polarisation at any vertical section, thereby creating a magnetic field working together between separate magnet segments (11*b*) vertically on the magnet rod (11) and between vertical magnetic segments (11*b*) of magnet rods (11) of neighbouring sets (111, 112, 113) of magnet rods (11), the device thereby creating a cross web of magnetic field on both the horizontal and vertical section between magnet rods (11) of each set (111*a-b*, 112*a-b*, 113*a*) and magnet rods (11) of neighbouring sets (111*a-b*, 112*a-b*, 113*a-b*) of magnet rods (11).

2. The device of claim 1, comprising at least one row of at least two magnet assemblies (10).

3. The device of claim 1, comprising at least two rows of magnet assemblies (10) for enabling continuous capturing of magnetic material.

4. The device of claim 1, wherein the magnet assemblies (10) include a handle device (14) to which the magnet rods (11) are fixed at an upper end and the magnet guider (17) to which the magnet rods (11) are fixed at a lower end.

5. The device of claim 1, wherein the frame assembly (30) is formed of a substantially U-shaped frame (31) such that the upper plate (32) is fixed between legs of the substantially U-shaped frame (31), and wherein the bottom (33) of the U-shaped frame (31) and the upper plate (32) include at least two rows of the corresponding holes (34, 35) for receiving the magnet assemblies (10).

6. The device of claim 1, wherein the frame assembly (30) includes at least two substantially U-shaped frames (31*a-b*) arranged in a series, the U-shaped frames (31*a-b*) each having an upper plate (32), wherein a respective U-shaped frame (41*a-b*) and upper plate (32) are provided with corresponding holes (34, 35) for receiving the magnet assemblies (10), arranged in series.

7. The device of claim 4, wherein the pairs of guiding bars (36*a-b*) extend between distal ends of the corresponding holes (34, 35) and are adapted for guiding and retaining the magnet assemblies (10), the guiding bars (36*a-b*) further configured to decrease speed of material flow through the device (100) to create turbulence behind the flow without significantly increasing pressure drop through the device (100).

8. The device of claim 5, wherein the pairs of guiding bars (36*a-b*) extend between distal ends of the corresponding holes (34, 35) and are adapted for guiding and retaining the magnet assemblies (10), the guiding bars (36*a-b*) further configured to decrease speed of material flow through the device (100) to create turbulence behind the flow without significantly increasing pressure drop through the device (100).

9. The device of claim 6, wherein the pairs of guiding bars (36*a-b*) extend between distal ends of the corresponding holes (34, 35) and are adapted for guiding and retaining the magnet assemblies (10), the guiding bars (36*a-b*) further configured to decrease speed of material flow through the device (100) to create turbulence behind the flow without significantly increasing pressure drop through the device (100).

10. The device of claim 1, wherein the magnet rods (11) include non-magnetic end portions (13*a*, 13*b*).

11. The device of claim 4, wherein the magnet assemblies (10) include a wiper assembly (20) that is movable between the magnet handle device (14) and the magnet guider (17) for removing captured magnetic material.

12. The device of claim 4, wherein the upper plate (32) of the frame assembly (30) includes upward projecting flanges (37) provided with recesses (38) for receiving and retaining the handle device (14) of the magnet assembly (10).

13. The device of claim 4, wherein the upper plate (32) of the frame assembly (30) includes upward projecting flanges (37) provided with recesses (38) for receiving and retaining the handle device (14) of the magnet assembly (10).

14. The device of claim 5, wherein the holes (35) of the upper plate (32) and the corresponding holes (34) of the U-shaped frame (31, 31*a-b*) respectively extend in a direction between longitudinal sides of the upper plate (32) and the U-shaped frame (31, 31*a-b*) with an angle deviating from a straight line between the longitudinal sides to allow positioning of the at least two magnet rods (11) of a magnet assembly (10) in a fixed position in the frame assembly (30), allowing the magnet rods (11) to be displaceable both in a longitudinal direction and a transversal direction in relation to the frame assembly (30) for providing a magnetic grid of magnet rods (11).

15. The device of claim 1, wherein the magnet rods (11) include permanent magnets.

16. The device of claim 1, wherein the magnet rods (11) include controllable magnets.

17. The device of claim 1, wherein one of the magnet assemblies is configured to be removable from the frame assembly while remaining ones of the magnet assemblies are arranged within the frame assembly.

18. The device of claim 1, wherein each one of the magnet assemblies includes a set of only two magnet rods.

* * * * *